US005826289A

United States Patent [19]

Catallo

[11] Patent Number: 5,826,289

[45] Date of Patent: Oct. 27, 1998

[54] WET PROCESSING SYSTEM FOR TREATING WETTED ROPED KNITTED FABRIC TUBES

[76] Inventor: Frank Catallo, 75 Channel Dr., Port Washington, N.Y. 11050

[21] Appl. No.: 974,927

[22] Filed: Nov. 20, 1997

Related U.S. Application Data

[63] Continuation-in-part of Ser. No. 722,951, Sep. 27, 1996, abandoned.

[51] Int. Cl.[6] ..... D06B 3/18

[52] U.S. Cl. ..... 8/152; 68/13 R; 68/22 R; 68/177

[58] Field of Search ..... 8/151, 152; 68/13 R, 68/22 R, 177, 178, 179

[56] References Cited

U.S. PATENT DOCUMENTS

| | | | |
|---|---|---|---|
| Re. 31,115 | 1/1983 | Catallo | 8/151 |
| 2,482,497 | 9/1949 | Miller | 68/179 X |
| 3,412,411 | 11/1968 | Cohn et al. | 8/151 |
| 3,508,286 | 4/1970 | Rosen | 8/151 |
| 4,155,227 | 5/1979 | Conti . | |
| 4,166,367 | 9/1979 | Sando et al. | 68/13 R X |
| 4,322,957 | 4/1982 | Nowicki et al. | 68/177 X |
| 4,799,367 | 1/1989 | Schuierer et al. | 68/13 R |
| 4,835,992 | 6/1989 | Koch | 68/13 R |
| 5,046,208 | 9/1991 | Catallo | 8/151 |

*Primary Examiner*—Philip R. Coe
*Attorney, Agent, or Firm*—Leo Fornero, Esq.

[57] ABSTRACT

This invention is directed to a wet processing system wherein a wet roped knitted fabric is treated to achieve a finished product that is flat and open and accomplished by moving the fabric so that it is transported through the various processing steps in a manner that minimizes distortion and elongation of the fabric. Advantage is also provided by utilizing a J-scray that is moveably disposed in the system to fine tune the accumulation of wetness and control the speed of delivery.

3 Claims, 3 Drawing Sheets

WET PROCESSING SYSTEM FOR TREATING WETTED ROPED KNITTED FABRIC TUBES

This application is a continuation-in-part of application Ser. No. 08/722,951, now abandoned.

BACKGROUND OF THE INVENTION

This invention relates generally to a wet processing system and apparatus for processing wetted knit fabric tubes and especially includes a system and apparatus which overcomes the usual elongation and wrinkling results achieved in the other forms of processing systems I am aware of.

U.S. Pat. Nos. 5,046,208 and 4,112,532 which is now U.S. Pat. No. Re 31,115 describe typically what is in normal use presently and what is disclosed provides the problem of fabric distortion and elongation resulting in the problems common with such deficiencies.

The deficiencies in part are overcome through the use of movable J-scrays clearly shown in FIG. 1 and may be moved either mechanically or automatically as is well known in the art. For example fabric runs between the individual components of these systems do not permit relaxation of the fabric between components resulting in elongation and fabric distortion. Also the arrangement of components in systems I am aware of makes them in accessible and less convenient to operate.

It is therefore an object of the present invention to provide a wet processing system for such fabrics that facilitates the treatment of same so that the deficiencies mentioned above are substantially diminished. This is accomplished by close association of the treating components with relaxation between the components so that the fabric may be transported from one to the other without damaging tension and the concomitant elongation.

Another object of this invention is to include a wetting system incorporating an arrangement that permits close control of the fabric movement through same to thereby provide a fabric that is wetted more closely to the desired degree.

For a more complete understanding of the invention and other features and advantages thereof reference should be made to the following detailed description of a preferred embodiment and to the accompanying drawings.

BRIEF DESCRIPTION OF THE DRAWINGS

In the drawings wherein like reference numerals denote corresponding parts through the several views.

GENERAL DESCRIPTION OF THE INVENTION

Figure 1:
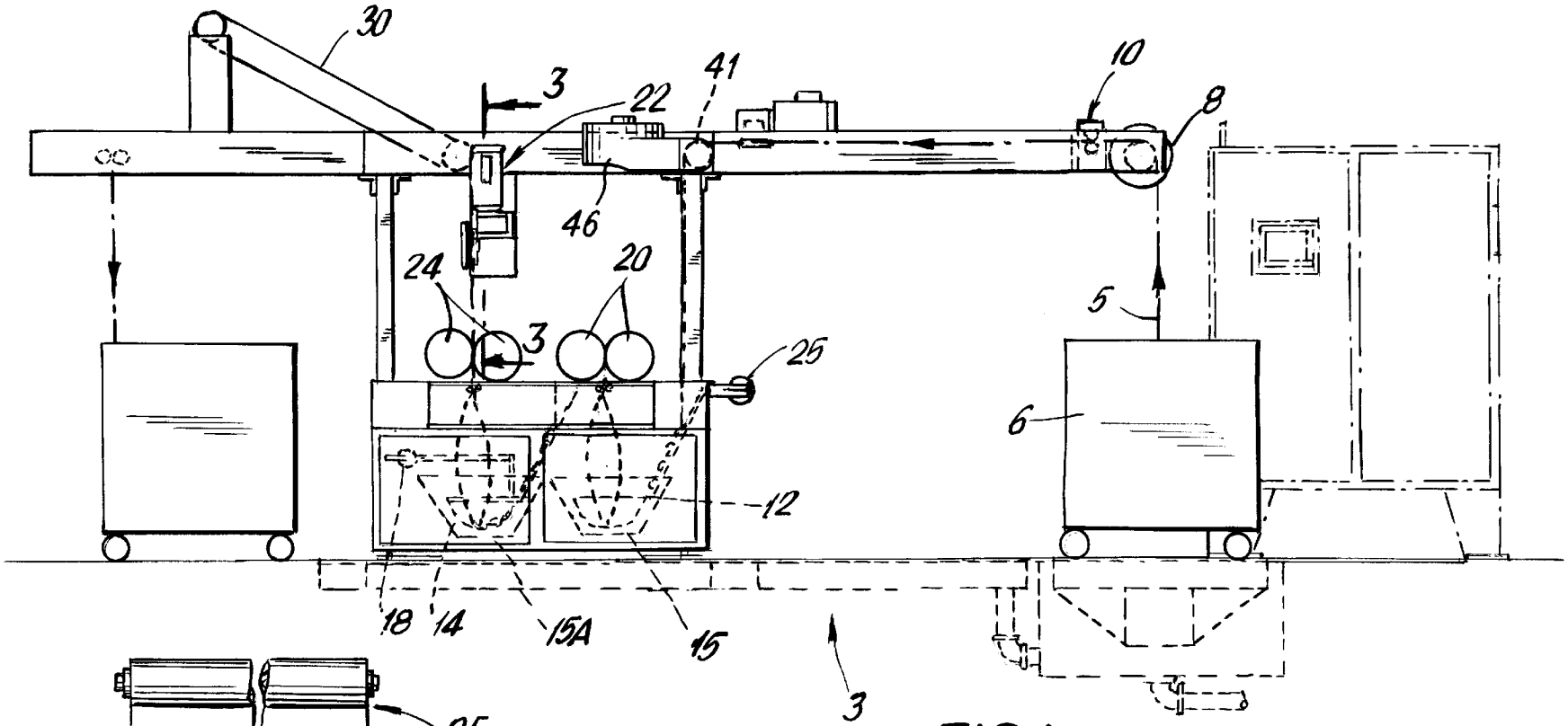
FIG. 1 is a schematic side view showing the wet processing system contemplate by this invention and disclosed herein.
Figure 4:
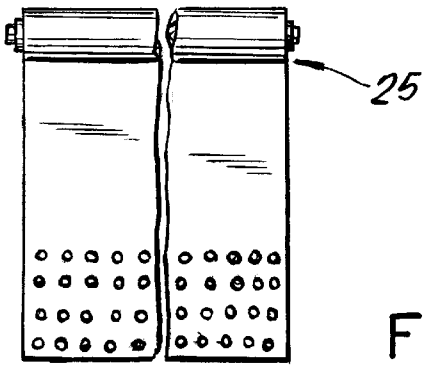
FIG. 4 is an end view showing the holes in the j-scray and schematically
Figure 2:
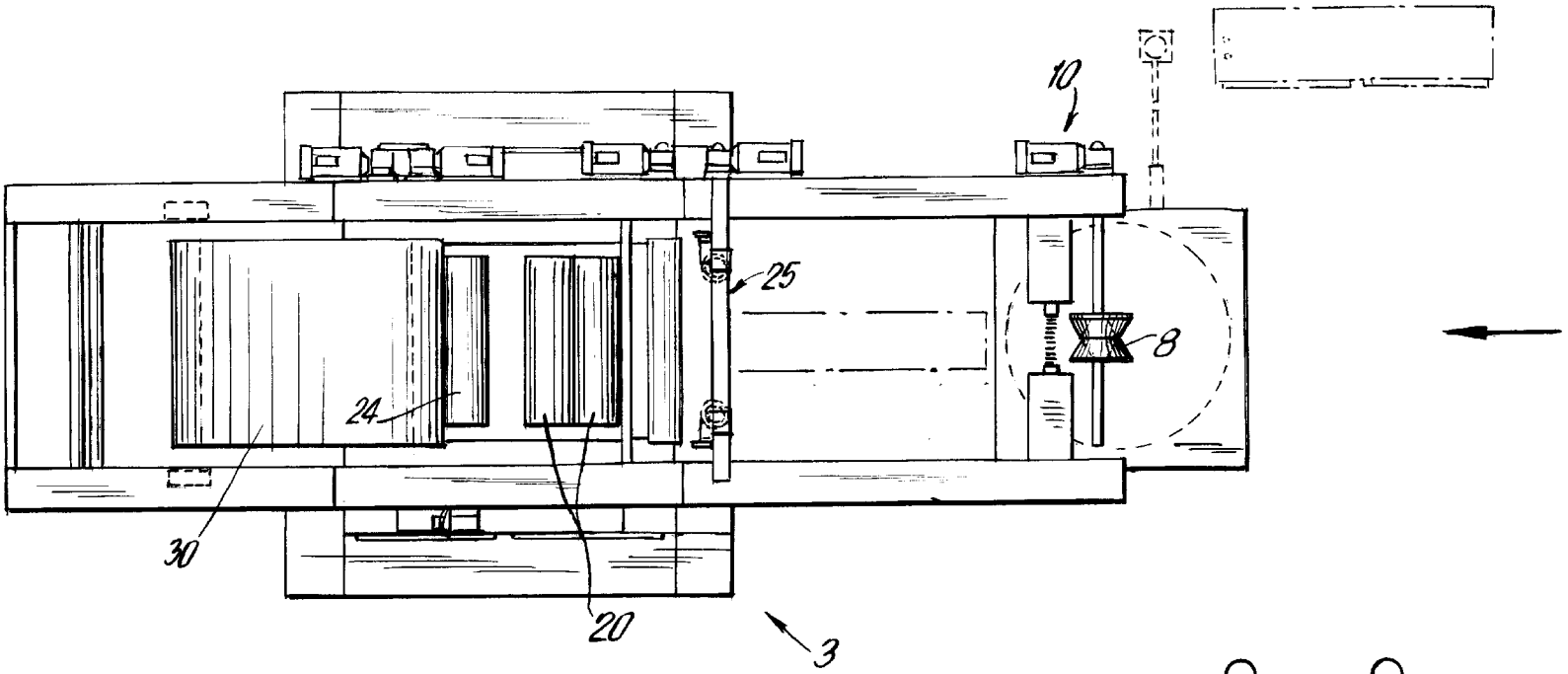
FIG. 2 is a top schematic view of the system shown in FIG. 1.
Figure 3:
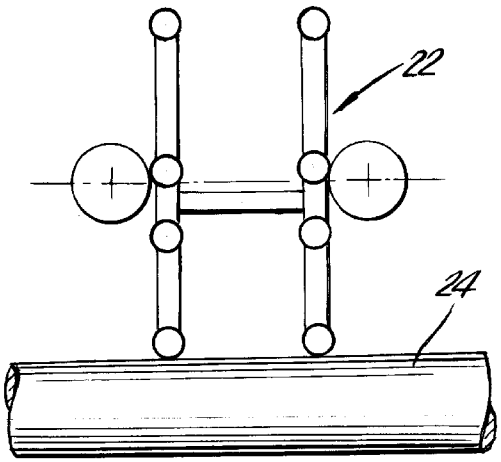
FIG. 3 is a view showing the spreader and taken a line 3—3 in FIG. 1.
Figure 5:
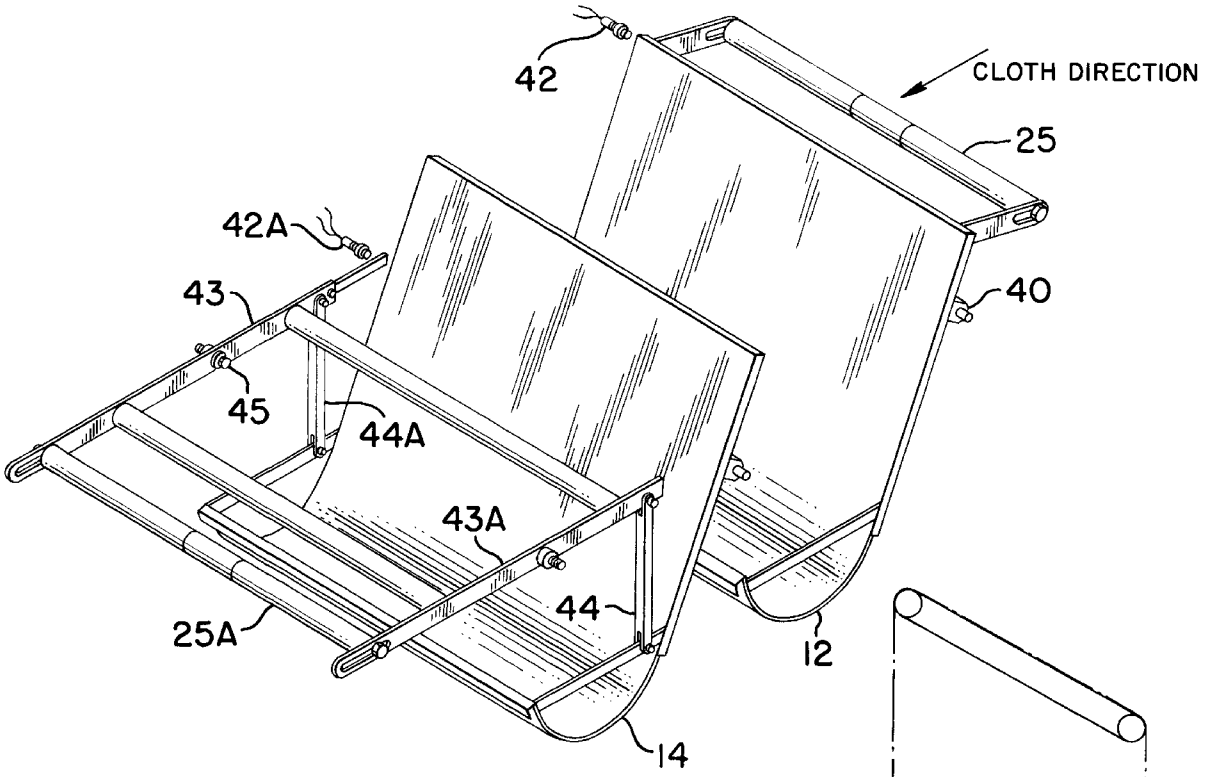
FIG. 5 is a view showing the interconnection of the J-Scrays.
Figure 6:
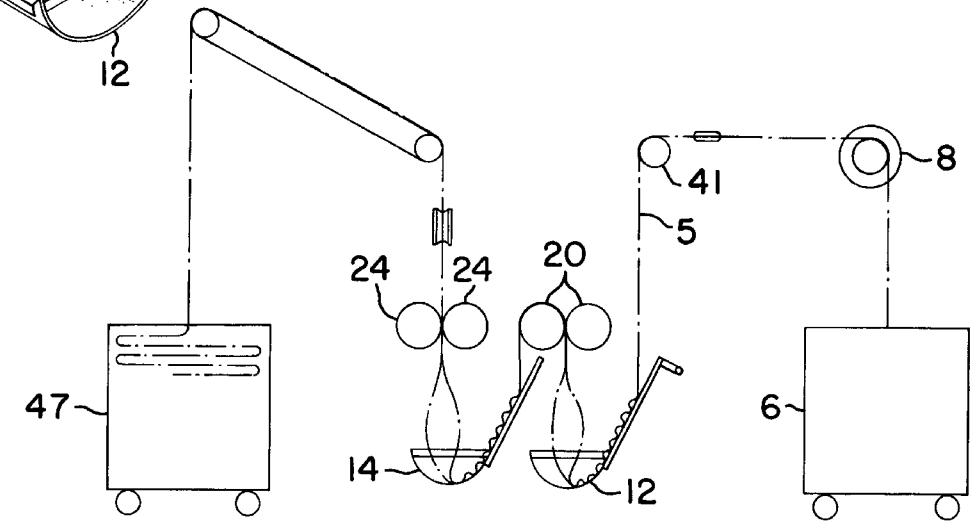
FIG. 6 is a view showing movement of the fabric through the J-Scrays and extraction rolls.

Referring to the drawings in detail the present invention, as will be seen, is shown as embodied in a continuous range, generally designated 3, wherein roped knitted tubular fabric 5 is delivered to the range, normally in a truck 6. Fabric 5 is drawn from the truck 6 by means of a roll 8 and moved horizontally over a twist sensing device 10 and ring guider arrangement known in the art, which open the fabric for delivery vertically into a j-scray 12 which is moveably balanced, as is shown schematically at 25 in the chamber 15. Providing a scray of this type permits you to control the speed of delivery of the fabric and the degree of wetting to a desired amount. If desired a second and similar j-scray 14 is arranged in the chamber 15 and in proximate relation to the first j-scray. This second j-scray has all of the features of the first scray and also is arranged to operate to control delivery speed and wetness. The second j-scray could be placed in a separate chamber or in the same chamber as the first j-scray and is normally used to apply chemicals. In FIG. 5 scray pivots around shaft 40 which is attached to the side walls of the apparatus as will be understood by one skilled in the art. The balance weight is adjusted to maintain a desired amount of cloth in the scray 12. When more or less web is delivered to the scray by feed roll 41 the balance is changed and proximity switch 42 signals drive motor 46 to either speed up or slow down to maintain the desired fabric accumulation in the scray. In a similar manner scray 14 receives web from the extracting nip 20 and the switch 42 A associated with Scray 14 controls the drive motor, not shown, to speed up or slow down extracting rolls 24 to maintain a desired accumulation in scray 14. The spreader 22 then delivers the web to a conveyor 30 by following electronically the rolls 24.

The balancing systen for scray 14 is arranged different from scray 12 for convenience. The balance weight 25A is located at the delivery end of the apparatus for accesibility. Weight 25 is at the entry end of the apparatus for the same reason. Levers 43 and 43A pivot around the shaft 45 attached to the side walls of the apparatus. These levers cooperate to balance scray 14. The web flow from container 6 to container 47 is automatic and tension free in of tension in the treating zone.

It should be understood that of course that specific forms of the invention herein illustrated and described are intended to be representative only as certain changes may be made in the invention without departing from the clear teachings of the disclosure. Accordingly, reference should be made to the following appended claims determining the full scope of the invention.

I claim:

1. A method for processing a wet roped knitted fabric tube comprising, (a) moving a wet fabric tube from a container to a wet processing system;

(b) opening the fabric tube as it travels horizontally over the wet processing system;

(c) delivering the open fabric tube vertically down into a J-type balance scray moveably disposed in the wet processing system which controls the speed of movement the opened knit fabric;

(d) wetting the fabric in the J-scray as desired;

(e) ballooning the open fabric as it moves vertically up and out of the J-scray to straighten same;

(f) moving the ballooned fabric into a pair of extraction rolls to set the fabric wetness as desired;

(g) moving the open fabric vertically upwards directly into a spreader that is closely located relative the extraction rolls to set width and reduce fabric distortion and elongation;

(h) transferring the open fabric via a conveyor which is arranged to do so with minimum distortion; and, (i) moving the open fabric into a truck for transport to other treating stations.

2. The method of processing roped knitted fabric of claim 1 wherein the open fabric is moved from a first set of extraction rolls into a J-box to a second J-box and into another pair of extraction rolls so that speed and wetness of the fabric is controlled.

3. The method of processing knitted fabric of claim 2 wherein the fabric is moved in synchronized fashion so that the wet processing system may quickly be adjusted to accommodate different fabric conditions.

* * * * *